US010270173B2

(12) United States Patent
Wu et al.

(10) Patent No.: US 10,270,173 B2
(45) Date of Patent: Apr. 23, 2019

(54) PATCH ANTENNA

(71) Applicant: PEGATRON CORPORATION, Taipei (TW)

(72) Inventors: Chien-Yi Wu, Taipei (TW); Ya-Jyun Li, Taipei (TW); Chao-Hsu Wu, Taipei (TW); Shih-Keng Huang, Taipei (TW); Hung-Ming Yu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 297 days.

(21) Appl. No.: 15/434,026

(22) Filed: Feb. 15, 2017

(65) Prior Publication Data

US 2017/0271768 A1 Sep. 21, 2017

(30) Foreign Application Priority Data

Mar. 16, 2016 (TW) ..... 105108140 A

(51) Int. Cl.

*H01Q 9/04* (2006.01)
*H01Q 1/48* (2006.01)
*H01Q 1/36* (2006.01)

(52) U.S. Cl.

CPC ..... *H01Q 9/0407* (2013.01); *H01Q 1/36* (2013.01); *H01Q 1/48* (2013.01)

(58) Field of Classification Search

CPC ..... H01Q 9/0407; H01Q 1/48; H01Q 1/36
See application file for complete search history.

(56) References Cited

U.S. PATENT DOCUMENTS 5,241,321 A * 8/1993 Tsao ..... H01Q 9/0435 343/700 MS
5,444,452 A * 8/1995 Itoh ..... H01Q 5/42 343/700 MS
6,392,610 B1 * 5/2002 Braun ..... H01Q 1/243 343/700 MS (Continued)

FOREIGN PATENT DOCUMENTS

TW I485927 B 5/2015
TW I496350 B 8/2015

OTHER PUBLICATIONS

B. Li et al., "Dual-polarised patch antenna with low cross-polarisation and high isolation for WiMAX applications," Electronics Letters, vol. 47, Issue 17, pp. 952-953, Aug. 18, 2011.

*Primary Examiner* — Jessica Han
*Assistant Examiner* — Jae K Kim
(74) *Attorney, Agent, or Firm* — McClure, Qualey & Rodack, LLP

(57) ABSTRACT

A patch antenna includes a grounding portion and a radiating portion. The radiating portion includes a first feeding point, a first grounding point, a second feeding point, and a second grounding point. The first feeding point is electrically connected to a first signal source. The first grounding point is electrically connected to the grounding portion. The second feeding point is electrically connected to a second signal source. The second grounding point electrically connected to the grounding portion. The line formed by connecting the first feeding point and the first grounding point is substantially perpendicular to the line formed by connecting the second feeding point and the second grounding point.

16 Claims, 11 Drawing Sheets

(56) References Cited

U.S. PATENT DOCUMENTS

| | | | | |
|---|---|---|---|---|
| 8,125,398 | B1 * | 2/2012 | Paulsen | F42B 10/62<br>102/214 |
| 2009/0262023 | A1 * | 10/2009 | Ying | H01Q 1/243<br>343/700 MS |
| 2017/0093041 | A1 * | 3/2017 | McMichael | H01Q 9/0435 |

* cited by examiner

PATCH ANTENNA

RELATED APPLICATIONS

This application claims priority to Taiwan Application Serial Number 105108140, filed Mar. 16, 2016, which is herein incorporated by reference.

BACKGROUND

Technology Field

The present disclosure relates to an antenna. More particularly, the present disclosure relates to a patch antenna.

Description of Related Art

With advances in technology, antennas are widely used in various electronic devices, such as used in mobile phones or tablet computers.

In some applications, an antenna module may have multiple antennas (e.g., have three 2.4 GHz antennas and three 5 GHz antennas) arranged in a ring. In such applications, when these antennas are omni-directional, these antennas may interfere with each other, and the quality of the communication would be decreased.

Thus, a new antenna design is desired.

SUMMARY

One aspect of the present disclosure is related to a patch antenna. In accordance with one embodiment of the present disclosure, the patch antenna includes a supporting element a grounding portion, and a radiating portion. The supporting element includes a first surface and a second surface. The grounding portion is disposed at the second surface of the supporting element. The radiating portion is disposed at the first surface of the supporting element. The radiating portion includes a first feeding point, a first grounding point, a second feeding point, and a second grounding point. The first feeding point is located at a first end of the radiating portion. The first grounding point is located at a second end of the radiating portion and electrically connected to the grounding portion, in which the second end of the radiating portion is opposite to the first end of the radiating portion. The second feeding point is located at a third end of the radiating portion. The second grounding point is located at a fourth end of the radiating portion and electrically connected to the grounding portion, in which the fourth end of the radiating portion is opposite to the third end of the radiating portion. The line formed by connecting the first feeding point and the first grounding point is substantially perpendicular to the line formed by connecting the second feeding point and the second grounding point.

In accordance with one embodiment of the present disclosure, the radiating portion is substantially symmetric along the line formed by connecting, the first feeding point and the first grounding point.

In accordance with one embodiment of the present disclosure, the radiating portion is substantially symmetric along the line formed by connecting the second feeding point and the second grounding point.

In accordance with one embodiment of the present disclosure, a shape of the radiating portion is a cross, a circle, rectangle, or a diamond.

In accordance with one embodiment of the present disclosure, the radiating portion has a center point, and a distance between the first feeding point and the center point is substantially equal to a distance between the second feeding point and the center point.

In accordance with one embodiment of the present disclosure, the radiating portion has a center point, and a distance between the first grounding point and the center point is substantially equal to a distance between the second grounding point and the center point.

In accordance with one embodiment of the present disclosure, the radiating portion forms a first slot, and the first slot surrounds the first feeding point.

In accordance with one embodiment of the present disclosure, the radiating portion forms a second slot, and the second slot surrounds the second feeding point.

Another aspect of the present disclosure is related to a patch antenna. In accordance with one embodiment of the present disclosure, the patch antenna includes a grounding portion and a radiating portion. The radiating portion includes a first feeding point a first grounding point a second feeding point, and a second grounding point. The first feeding point is electrically connected to a first signal source. The first grounding point is electrically connected to the grounding portion. The second feeding point is electrically connected to a second signal source. The second grounding point is electrically connected to the grounding portion. The line formed by connecting the first feeding point and the first grounding point is substantially perpendicular to the line formed by connecting the second feeding point and the second grounding point.

In accordance with one embodiment of the present disclosure, the radiating portion is substantially symmetric along the line formed by connecting the first feeding point and the first grounding point.

In accordance with one embodiment of the present disclosure, the radiating portion is substantially symmetric along the line formed by connecting the second feeding point and the second grounding point.

In accordance with one embodiment of the present disclosure, a shape of the radiating portion is a cross, a circle, a rectangle, or a diamond.

In accordance with one embodiment of the present disclosure, the radiating portion has a center point, and a distance between the first feeding point and the center point is substantially equal to a distance between the second feeding point and the center point.

In accordance with one embodiment of the present disclosure, the radiating portion has a center point, and a distance between the first grounding point and the center point is substantially equal to a distance between the second grounding point, and the center point.

In accordance with one embodiment of the present disclosure, the radiating portion forms a first slot, and the first slot surrounds the first feeding point.

In accordance with one embodiment of the present disclosure, the radiating portion fortes a second slot, and the second slot surrounds the second feeding point.

Through utilizing one embodiment described above, a two-feed two-polarization antenna can be realized. The two-feed two-polarization antenna is highly directional and has high performance. By applying such a two-feed two-polarization antenna, interferences among antennas in an antenna module can be avoided, and the performance of the antenna module can be increased.

DETAILED DESCRIPTION

Figure 1:
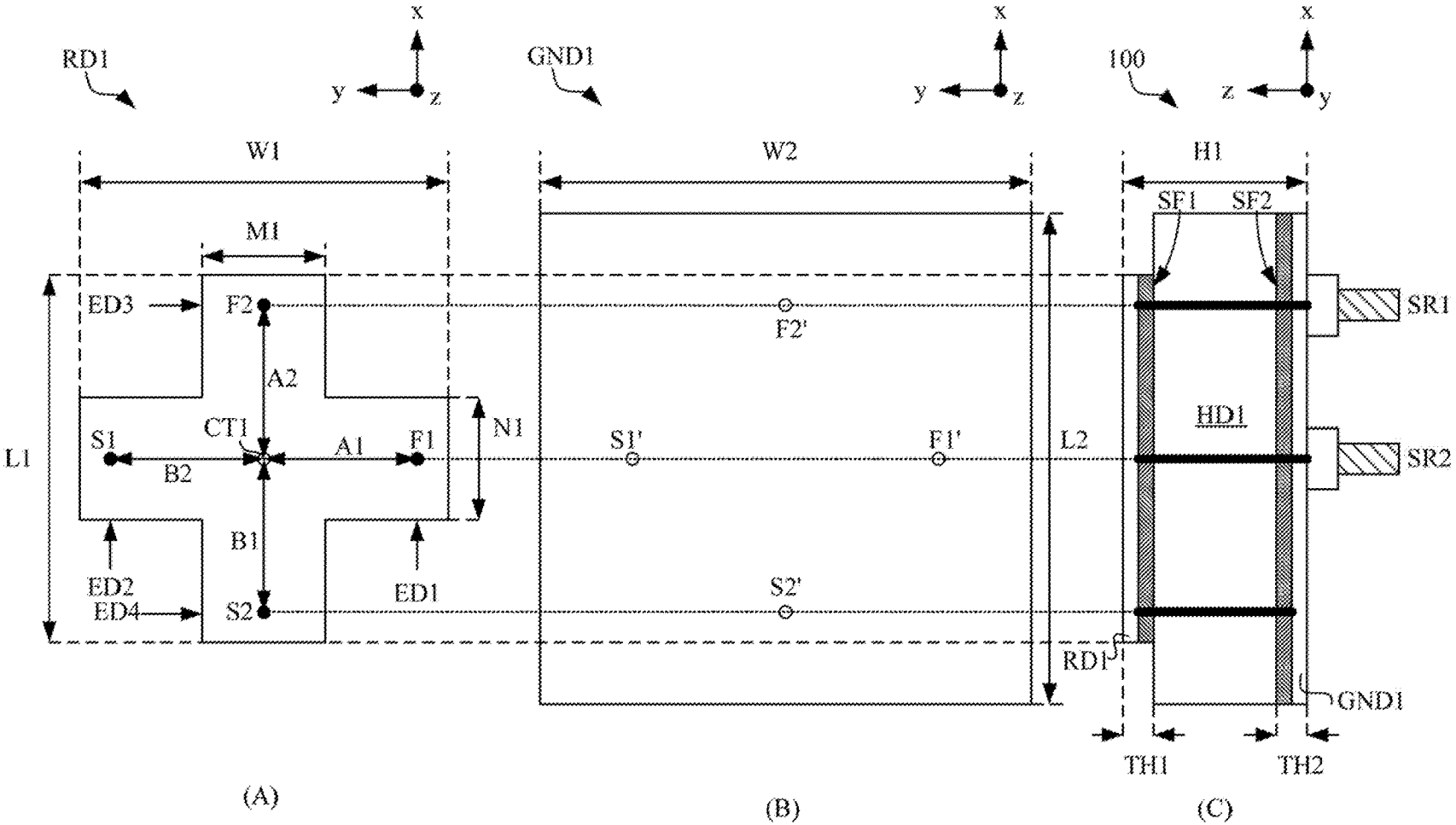
FIG. 1 illustrates schematic diagrams of a patch antenna according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, although the terms first "second," etc. may be used herein to describe various elements, these elements should not be limited by these terms. These terms are only used to distinguish one element from another. For example, a first element could be termed a second element, and, similarly, a second element could be termed a first element, without departing from the scope of the embodiment.

It will be understood that, in the description herein and throughout the claims that follow, when an element is referred to as being "connected" or "electrically connected" to another element, it, can be directly connected to the other element or intervening elements may be present. In contrast, when an element is referred to as being "directly connected" to another element, there are no intervening elements present. Moreover, "electrically connect" or "connect" can further refer to the interoperation or interaction between two or more elements.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, words indicating direction used in the description of the following embodiments, such as "above," "below," "left," "right," "front" and "back," are directions as they relate to the accompanying drawings. Therefore, such words indicating direction are used for illustration and do not limit the present disclosure.

It will be understood that, in the description herein and throng hoot the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that, in the description herein and throughout the claims that follow, the range of error to the values modified by the term "substantially" is generally 20%, and it can be 10% in some preferred cases, and moreover, it can also be 5% in sore most preferred cases.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

FIG. 1(A)-FIG. 1(C) are schematic diagrams of a patch antenna 100 according to one embodiment of the present disclosure. In this embodiment, the patch antenna 100 includes a supporting element HD1, a grounding portion GND1 and a radiating portion RD1. In this embodiment, the supporting element HD1 has a first surface SF1 and a second surface SF2. In this embodiment, the radiating portion RD1 is disposed at the first surface SF1 of the supporting element HD1, and the grounding portion GND1 is disposed at the second surface SF2 of the supporting element HD1. In one embodiment, the supporting element HD1 can be changed or omitted on a basis of actual requirements, and the present disclosure is not limited to the embodiment described above.

In this embodiment, the supporting element HD1 can be realized by using insulating material, such as plastic, but is not limited in this regard. In this embodiment the radiating portion RD1 can be realized by using a foil, and is disposed on a supporting substrate (e.g., an FR-4 substrate) disposed at the first surface SF1 of the supporting element HD1 (e.g., as the gray region in FIG. 1(C) illustrating), but is not limited in this regard. In one embodiment, the radiating portion RD1 can be directly disposed on the supporting element HD1 without a supporting substrate intervened. In this embodiment, the grounding portion GND1 can be realized by using a foil, and is disposed on a supporting, substrate (e.g., an FR-4 substrate) disposed at the second surface SF2 of the supporting element HD1, but is not limited in this regard. In one embodiment, the grounding portion GND1 can be directly disposed on the supporting element HD1 without a supporting substrate intervened.

In this embodiment, a shape of the radiating portion RD1 is a cross, but other shapes (e.g., a circle, a rectangle, are a diamond) are within the contemplated scope of the present disclosure. In one embodiment, the radiating portion RD1 includes a first feeding point F1, a first grounding point S1, a second feeding point F2, and a second grounding point S2. The first feeding point F1 is located at a first end ED1 of the radiating portion RD1, the first grounding point S1 is located at a second end ED2 of the radiating portion RD1, the second feeding point F2 is located at a third end ED3 of the radiating portion RD1, and the second grounding point S2 is located at a fourth end ED4 of the radiating portion RD1, in which the first end ED1 of the radiating portion RD1 and the second end ED2 of the radiating portion RD1 are opposite to each other, and the third end ED3 of the radiating portion RD1 and the fourth end ED4 of the radiating portion RD1 are opposite to each other. In this embodiment, the line formed by connecting the first feeding point F1 and the first grounding point S1 is substantially perpendicular to the line formed by connecting the second feeding point F2 and the second grounding point S.

In one embodiment, the radiating portion RD1 is substantially symmetric along the line formed by connecting the first feeding point F1 and the first grounding point S1. In one embodiment the radiating portion RD1 is substantially symmetric along the line formed by connecting the second feeding point F2 and the second grounding point S2.

In this embodiment, the first feeding point F1 passes through a hole F1 on the grounding portion GND1 by penetrating a through hole of the supporting element HD1, and is electrically connected to a signal source SR1 (e.g., a coaxial cable). The second feeding point F2 passes through a hole F2' on the grounding portion GND1 by penetrating a through hole of the supporting element HD1, and is electrically connected to a signal source SR2 (e.g., a coaxial cable). The first grounding point S1 is electrically connected to a point S1' on the grounding portion GND1 by penetrating a through hole of the supporting element HD1. The second grounding point S2 is electrically connected to a point S2' on the grounding portion GND1 by penetrating a through hole of the supporting element HD1.

In one embodiment, the height H1 (e.g., the height on a z-axis) of the patch antenna 100 can be 5 mm the summed thickness TH1 (e.g., the thickness on the z-axis) of the radiating portion. RD1 and the supporting substrate (e.g., the FR-4 substrate) can be 0.8 mm, the summed thickness TH2 (e.g., the thickness on the z-axis) of the grounding portion GND1 and the supporting substrate (e.g., the FR-4 substrate) can be 0.8 mm, the length L1 (e.g., the length on an x-axis) of the radiating portion RD1 can be 25 mm, the width W1 (e.g., the width on a y-axis) of the radiating portion RD1 can be 25 mm, the widths N1 (e.g., widths on the y-axis) of the first end ED1 and the first end ED2 of the radiating portion RD1 can be 4 mm, the widths M1 (e.g., widths on the x-axis) of the third end ED3 and the fourth end ED4 of the radiating portion RD1 can be 4 mm, the length L2 (e.g., the length on the x-axis) of the grounding portion GND1 can be 35 mm, and the width W2 (e.g., the width on the y-axis) of the grounding portion GND1 can be 35 mm. It should be noted that the values described above are for illustrative purposes, and other values are within the contemplated scope of the present disclosure.

In one embodiment, the radiating portion RD1 has a center point CT1 (a middle point of both of the length L1 and the width W1 of the radiating portion RD1). A distance A1 between the first feeding point F1 and the center point CT1 is substantially equal to a distance A2 between the second feeding point F2 and the center point CT1. In one embodiment, a distance B1 between the first grounding point S1 and the center point CT1 is substantially equal to a distance B2 between the second grounding point S2 and the center point CT1. In one embodiment, the distances A1, A2 can be equal to or different from the distances B1, B2. In one embodiment, the distances A1, A2 can be 9.5 mm. In one embodiment, the distances B1, B2 can be 10.5 mm. It should be noted that the values described above are for illustrative purposes, and other values are within the contemplated scope of the present disclosure.

Additionally, in some embodiments, the distances A1, A2 and/or distances B1, B2 can be adaptively adjusted, so as to adjust the resonant frequency and the impedance matching of the patch antenna 100.

Figure 2:
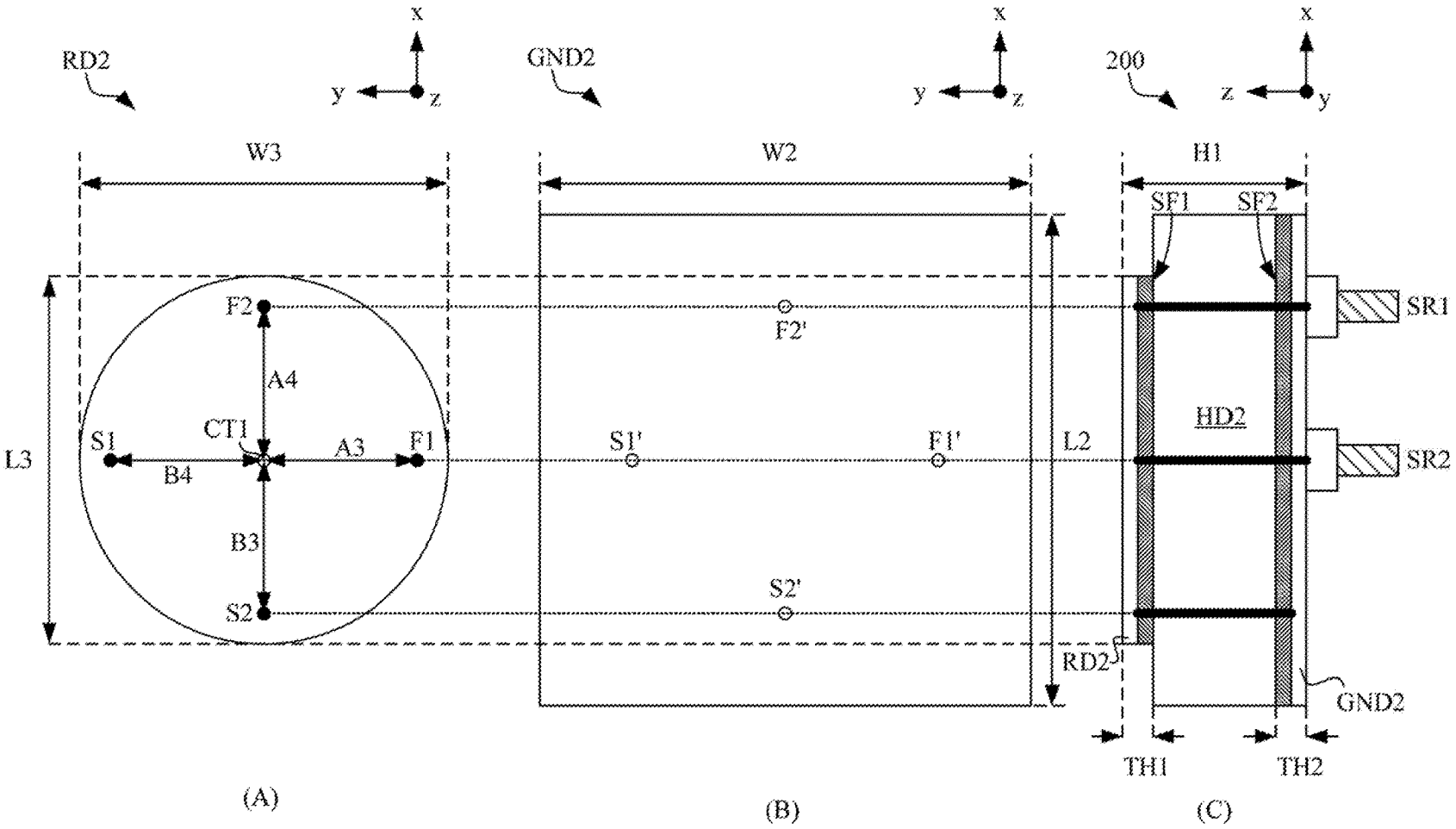
FIG. 2 illustrates schematic diagrams of a patch antenna according to another embodiment of the present disclosure.

FIG. 2(A)-FIG. 2(C) are schematic diagrams of a patch antenna 200 according to one embodiment of the present disclosure. In this embodiment, the patch antenna 200 includes a supporting element HD2, a grounding portion GND2, and a radiating portion RD2. In this embodiment, the patch antenna 200 is substantially identical to the patch antenna 100, except that the shape of the radiating portion RD2 of the patch antenna 200 is circle. Therefore, in the paragraphs below, a description of many aspects that are similar will not be repeated.

In this embodiment, the supporting element HD2 can be realized by using insulating material, such as plastic, but is not limited in this regard. The radiating portion RD2 can be realized by using a foil disposed on a supporting substrate (e.g., an FR-4 substrate), but is not limited in this regard. The grounding portion GND2 can be realized by using a foil disposed on a supporting substrate (e.g., an FR-4 substrate), but is not limited in this regard.

In one embodiment, the first feeding point F1, the first grounding point S1, the second feeding point F2, and the second grounding point S2 of the radiating portion RD2 are separately located at four ends of the radiating portion RD2, in which the first feeding point F1 and the second feeding point F2 are opposite to each other, and the first grounding point S1 and the second grounding point S2 are opposite to each other. In this embodiment, the line formed by connecting the first feeding point F1 and the first grounding point S1 is substantially perpendicular to the line formed by connecting the second feeding point F2 and the second grounding point S2.

In one embodiment, the radiating portion RD2 is substantially symmetric along the line formed by connecting the first feeding point F1 and the first grounding point S1. In one embodiment, the radiating portion RD2 is substantially symmetric along the line formed by connecting the second feeding point F2 and the second grounding point S2.

In one embodiment, the height H1 (e.g., the height on the z-axis) of the patch antenna 200 can be 5 mm, the summed thickness TH1 (e.g., the thickness on the z-axis) of the radiating portion RD2 and the supporting substrate (e.g., the FR-4 substrate) can be 0.8 mm, the summed thickness TH2 (e.g., the thickness on the z-axis) of the grounding portion GND2 and the supporting substrate (e.g., the FR-4 substrate) can be 0.8 mm, the length L3 (e.g., the length on the x-axis) of the radiating portion RD2 can be 26 mm, the width W3 (e.g., the width on the y-axis) of the radiating portion RD2 can be 26 mm, the length L2 (e.g., the length on the x-axis)

of the grounding portion GND2 can be 35 mm, and the width W2 (e.g., the width on the y-axis) of the grounding portion GND2 can be 36 mm. It should be noted that the values described above are for illustrative purposes, and other values are within the contemplated scope of the present disclosure.

In one embodiment, the radiating portion RD2 has a center point CT1 (a middle point of both of the length L3 and the width W3 of the radiating portion RD2). A distance A3 between the first feeding point F1 and the center point CT1 is substantially equal to a distance A4 between the second feeding point F2 and the center point CT1. In one embodiment, a distance B3 between the first grounding point S1 and the center point CT1 is substantially equal to a distance B4 between the second grounding point S2 and the center point CT1. In one embodiment, the distances A3, A4 can be equal to or different from the distances B3, B4. In one embodiment, the distances A3, A4 can be 11.5 mm. In one embodiment, the distances B3, B4 can be 11.5 mm. It should be noted that the values described above are for illustrative purposes, and other values are within the contemplated scope of the present disclosure.

Additionally, in some embodiments, the distances A3, A4 and/or distances B3, B4 can be adaptively adjusted, so as to adjust the resonant frequency and the impedance matching of the patch antenna 200.

Figure 3:
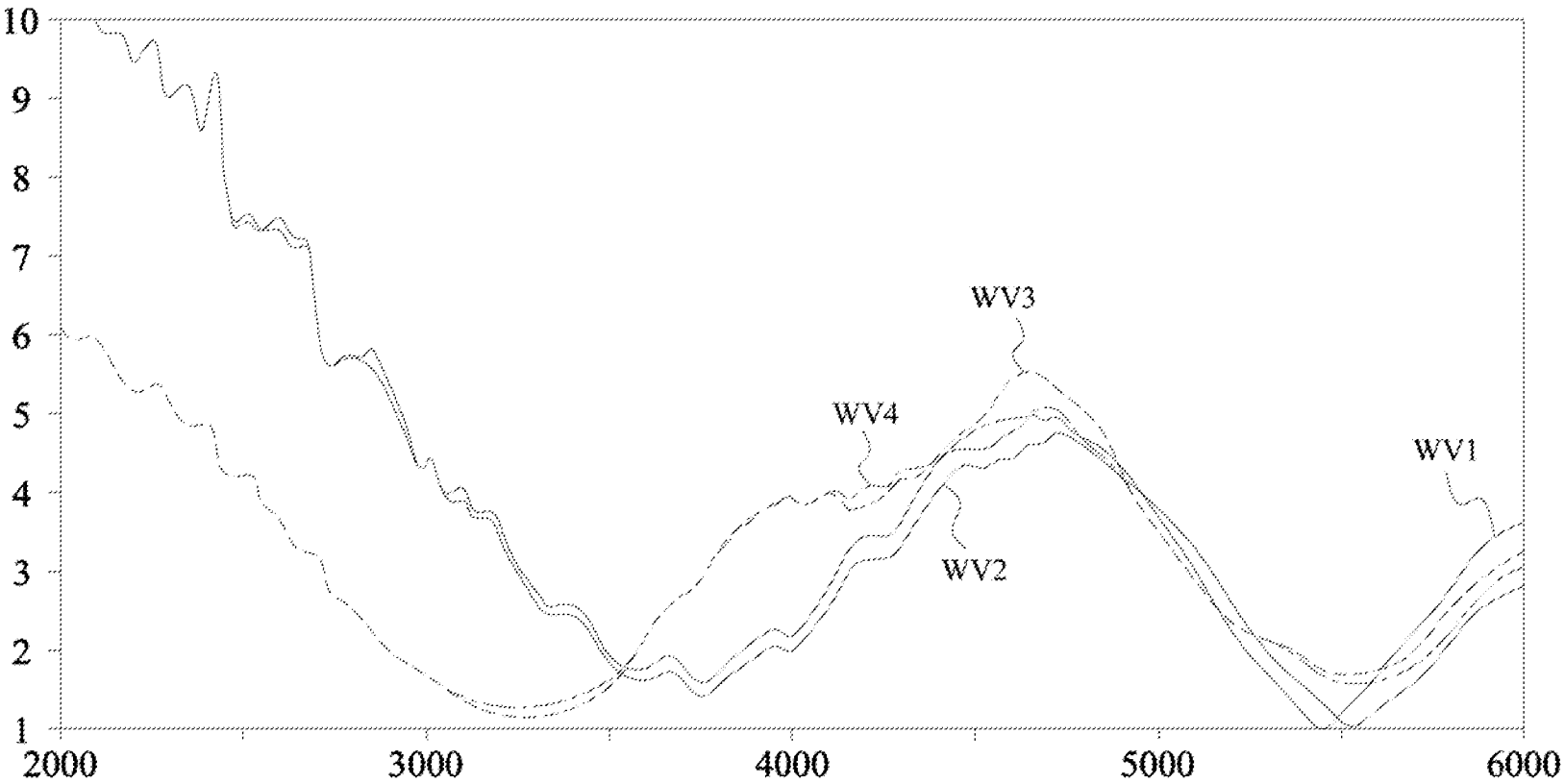
FIG. 3 illustrates relationships between frequencies and voltage standing wave ratios (VSWRs) of patch antennas according to one embodiment of the present disclosure.

FIG. 3 illustrates relationships between frequencies and voltage standing wave ratios (VSWRs) of patch antennas 100, 200 according to one embodiment of the present disclosure. The waveform WV1 indicates a relationship between a frequency and a voltage standing wave ratio VSWR) of the first feeding point F1 of the patch antenna 100. The waveform WV2 indicates a relationship between a frequency and a voltage standing wave ratio (VSWR) of the second feeding point F2 of the patch antenna 100. The waveform WV3 indicates a relationship between a frequency and a voltage standing wave ratio (VSWR) of the first feeding point F1 of the patch antenna 200. The waveform WV4 indicates a relationship between a frequency and a voltage standing wave ratio (VSWR) of the second feeding point F2 of the patch antenna 200.

Figure 4:
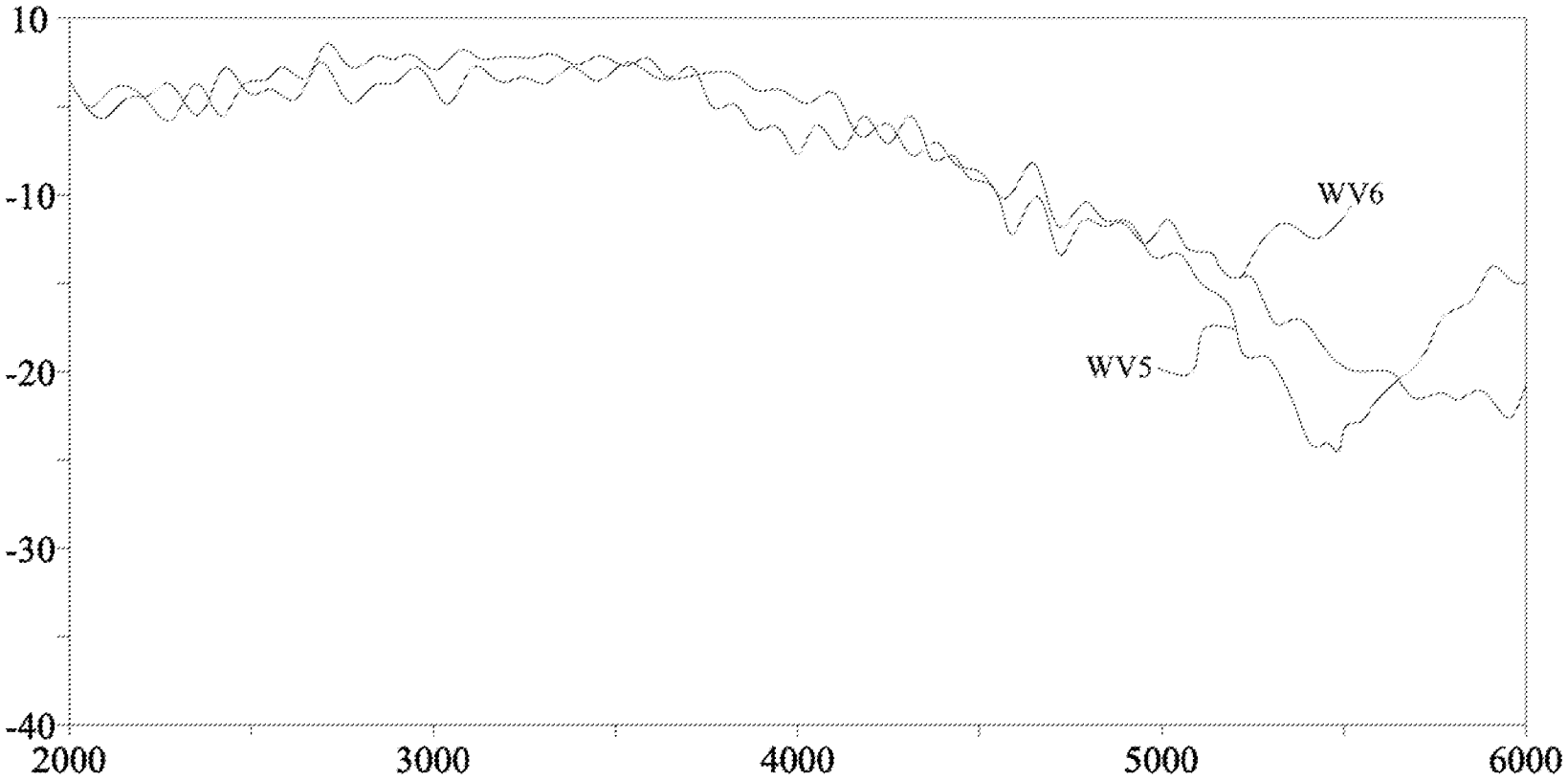
FIG. 4 illustrates relationships between frequencies and isolations of patch antennas according to one embodiment of the present disclosure.

FIG. 4 illustrates relationships between frequencies and isolations of patch antennas 100, 200 according to one embodiment of the present disclosure. The waveform WV5 indicates a relationship between a frequency and an isolation of the patch antenna 100. The waveform WV5 indicates a relationship between a frequency and an isolation of the patch antenna 200.

The table below illustrates antenna performances and maximum gains of different feeding points F1, F2 of different patch antennas 100, 200 corresponding to different frequencies in one embodiment.

| | first feeding point F1 of patch antenna 100 | | second feeding point F2 of patch antenna 100 | |
|---|---|---|---|---|
| frequency (MHz) | performance (dB) | maximum gain(dBi) | performance (dB) | maximum gain(dBi) |
| 5150 | −1.59 | 6.72 | −1.86 | 6.05 |
| 5250 | −1.23 | 7.56 | −1.60 | 6.78 |
| 5350 | −0.86 | 7.98 | −0.82 | 7.45 |
| 5450 | −0.72 | 8.12 | −085 | 7.73 |
| 5550 | −0.63 | 7.90 | −0.68 | 8.01 |
| 5650 | −1.32 | 6.74 | −0.91 | 7.43 |
| 5750 | −1.83 | 6.03 | −1.51 | 6.75 |
| 5850 | −1.89 | 5.73 | −1.58 | 6.93 |

-continued

| | first feeding point F1 of patch antenna 200 | | second feeding point F2 of patch antenna 200 | |
|---|---|---|---|---|
| frequency (MHz) | performance (dB) | maximum gain(dBi) | performance (dB) | maximum gain(dBi) |
| 5150 | −1.76 | 6.94 | −1.67 | 6.87 |
| 5250 | −1.58 | 7.57 | −1.63 | 7.27 |
| 5350 | −1.27 | 8.20 | −0.98 | 7.88 |
| 5450 | −0.94 | 8.67 | −0.92 | 8.40 |
| 5550 | −0.80 | 8.85 | −0.87 | 8.57 |
| 5650 | −1.34 | 7.74 | −1.10 | 7.78 |
| 5750 | −1.85 | 7.22 | −1.76 | 7.27 |
| 5850 | −1.89 | 6.94 | −1.79 | 7.24 |

Figure 5A:
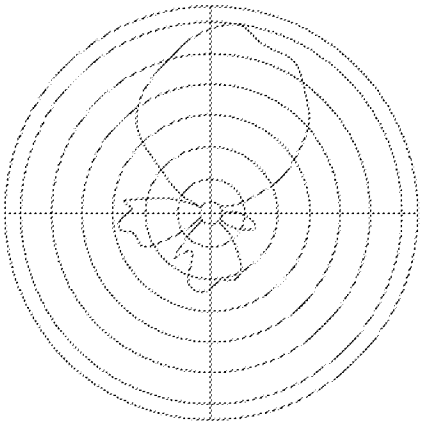
FIG. 5(A) illustrates a co-polarization radiation pattern of a first feeding point of a patch antenna according to one embodiment of the present disclosure.
Figure 5B:
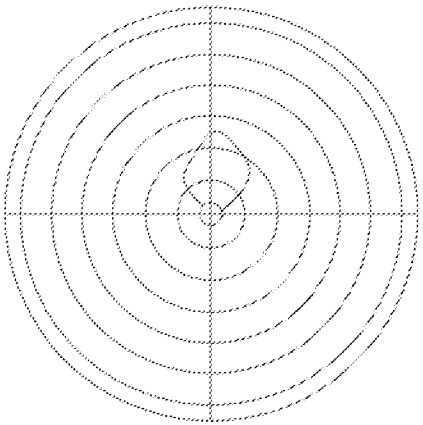
FIG. 5(B) illustrates a cross polarization radiation pattern of a first feeding point of a patch antenna according to one embodiment of the present disclosure.
Figure 5C:
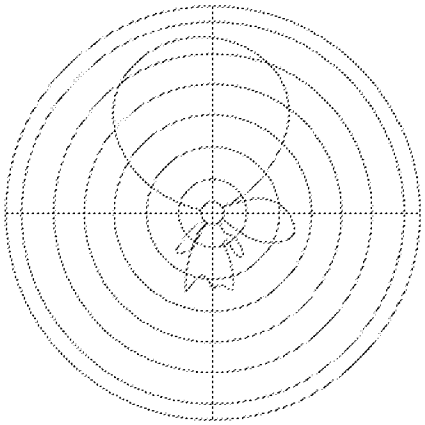
FIG. 5(C) illustrates a co-polarization radiation pattern of a second feeding point of a patch antenna according to one embodiment of the present disclosure.
Figure 5D:
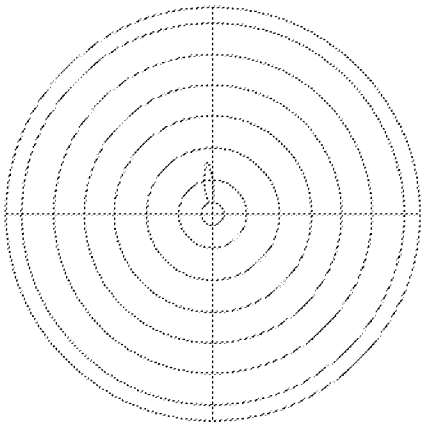
FIG. 5(D) illustrates a cross polarization radiation pattern of a second feeding point of a patch antenna according to one embodiment of the present disclosure.

FIG. 5(A) illustrates a co-polarization radiation pattern of a first feeding point F1 of the patch antenna 100 according to one embodiment of the present disclosure. FIG. 5(B) illustrates a cross polarization radiation pattern of the first feeding point F1 of the patch antenna 100 according to one embodiment of the present disclosure. FIG. 5(C) illustrates a co-polarization radiation pattern of the second feeding point F2 of the patch antenna 100 according to one embodiment of the present disclosure. FIG. 5(D) illustrates a cross polarization radiation pattern of the second feeding point F2 of the patch antenna 100 according to one embodiment of the present disclosure.

Figure 6A:
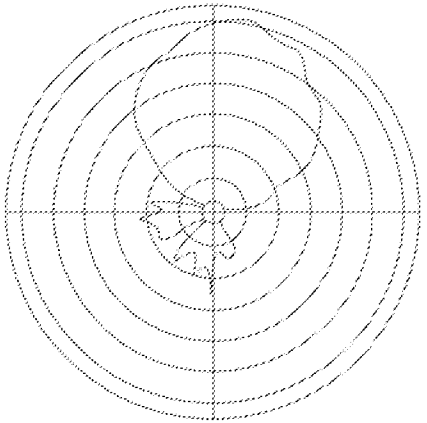
FIG. 6(A) illustrates a co-polarization radiation pattern of a first feeding point of a patch antenna according to another embodiment of the present disclosure.
Figure 6B:
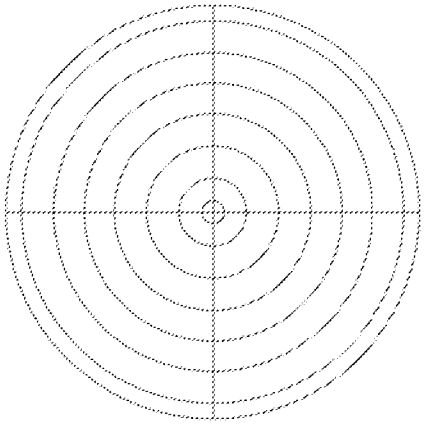
FIG. 6(B) illustrates a cross polarization radiation pattern of a first feeding point of a patch antenna carding to another embodiment of the present disclosure.
Figure 6C:
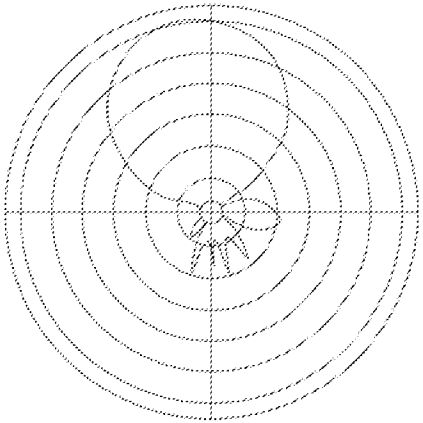
FIG. 6(C) illustrates a co-polarization radiation pattern of a second feeding point of a patch antenna according to another embodiment of the present disclosure.
Figure 6D:
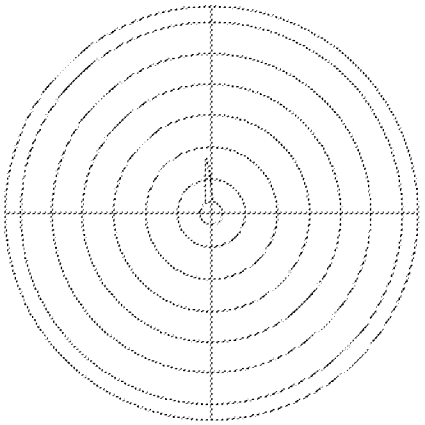
FIG. 6(D) illustrates a cross polarization radiation pattern of a second feeding point of a patch antenna according to another embodiment of the present disclosure.

FIG. 6(A) illustrates a co-polarization radiation pattern of a first feeding point F1 of the patch antenna 200 according to one embodiment of the present disclosure. FIG. 6(B) illustrates a cross polarization radiation pattern of the first feeding point F1 of the patch antenna 200 according to one embodiment of the present disclosure. FIG. 6(C) illustrates a co-polarization radiation pattern of the second feeding point F2 of the patch antenna 200 according to one embodiment of the present disclosure, FIG. 6(D) illustrates a cross polarization radiation pattern of the second feeding point F2 of the patch antenna 200 according to one embodiment of the present disclosure.

As illustrated above, by using the configuration in FIG. 1(A)-FIG. 1(C) or FIG. 2(A)-FIG. 2(C), the patch antennas 100, 200 can resonate between 5150 MHz-5875 MHz. In addition, the patch antennas 100, 200 have maximum polarization patterns at different axis, so that the patch antennas 100, 200 can transmit or receive signals with different polarization directions via different antennas with different polarization directions formed by different feeding points F1, F2, so as to increase the accuracy of signal receiving and signal transmitting. Additionally, the isolations of the antennas with different polarization directions formed by the two feeding points F1, F2 of the patch antennas 100, 200 are lower than −10 dB, so that the interference between the antennas with different polarization directions can be avoided. Moreover, in 5150 MHz-5850 MHz, the performances of the patch antennas 100, 200 are greater than −2 dB, and the maximum gain are greater than 5.5 dBi, so that great antenna performance can be achieved. Moreover, the differences between the co-polarization radiation patterns and the cross-polarization radiation patterns of the patch antennas 100, 200 are greater than 10 dB, the back radiation of the patch antennas 100, 200 are small, and the patch antennas 100, 200 are highly directionally, so that it can avoid interfering adjacent antennas or being interfered by adjacent antennas.

Figure 7:
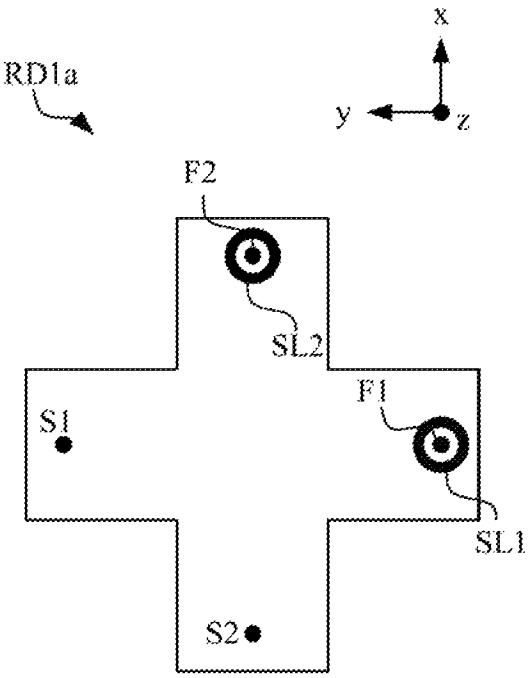
FIG. 7 is a schematic diagram of a radiation portion of a patch antenna according to one embodiment of the present disclosure.

FIG. 7 is a schematic diagram of a radiation portion RD1*a* of a patch antenna 100*a* according to one embodiment of the present disclosure. In this embodiment, the radiation portion RD1*a* of the patch antenna 100*a* is substantially identical to the radiation portion. RD1 of the patch antenna 100, and therefore, in the paragraphs below, a description of many aspects that are similar will not be repeated.

In this embodiment, the radiation portion RD1*a* can form a first slot SL1, and the first slot SL1 surrounds the first feeding point F1. In this embodiment, the radiation portion RD1*a* can form a second slot SL2, and the second slot SL2 surrounds the first feeding point F2. In one embodiment, the first slot SL1 can surround the first feeding point F1 with a ring shape, but other shapes are within the contemplated scope of the present disclosure. In one embodiment, the second slot SL2 can surround the first feeding point F2 with a ring shape, but other shapes are within the contemplated scope of the present disclosure. In one embodiment, the width of the first slot SL1 is 0.5 mm. In one embodiment, the width of the second slot SL2 is 0.5 mm.

Figure 8:
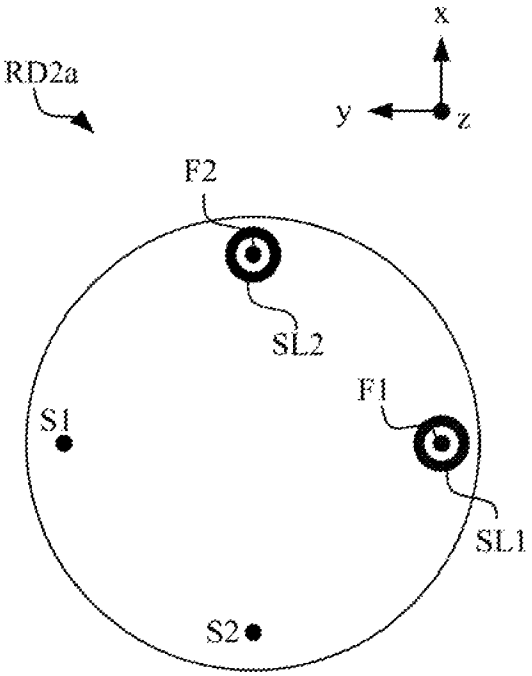
FIG. 8 is a schematic diagram of a radiation portion of a patch antenna according to another embodiment of the present disclosure.

FIG. 8 is a schematic diagram of a radiation portion RD2*a* of a patch antenna 200*a* according to one embodiment of the present disclosure. In this embodiment the radiation portion RD2*a* of the patch antenna 200*a* is substantially identical to the radiation portion RD2 of the patch antenna 200, and therefore, in the paragraphs below, a description of many aspects that are similar will not be repeated.

In this embodiment, the radiation portion RD2*a* can form a first slot SL1, and the first slot SL1 surrounds the first feeding point F1. In this embodiment, the radiation portion RD2*a* can form a second slot SL2, and the second slot SL2 surrounds the first feeding point F2. In one embodiment, the first slot SL1 can surround the first feeding point F1 with a ring shape, but other shapes are within the contemplated scope of the present disclosure. In one embodiment, the and slot SL2 can surround the first feeding point F2 with a ring shape, but, other shapes are within the contemplated scope of the present disclosure. In one embodiment, the width of the first slot SL1 is 0.5 mm. In one embodiment, the width of the second slot SL2 is 0.5 mm.

By using the first slot SL1 and/or the second slot SL2, the bandwidth and the impedance matching of the patch antennas 100*a*, 200*a* can be improved.

Figure 9:
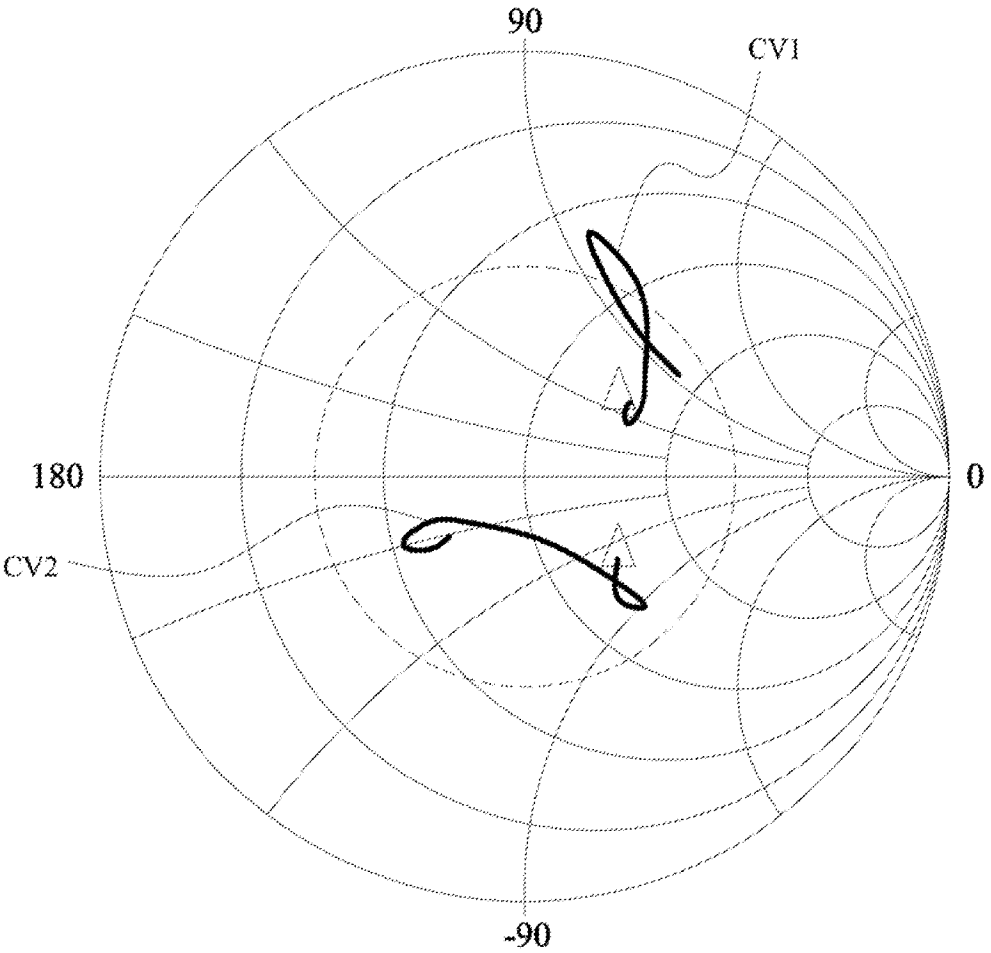
FIG. 9 illustrates a smith chart of patch antennas according to one embodiment of the present disclosure.

FIG. 9 illustrates a smith chart of patch antennas 200, 200*a* according to another embodiment of the present disclosure. Curve CV1 represents the antenna characteristic of an antenna formed by the first feeding point F1 of the patch antenna 200. Curve CV2 represents the antenna characteristic of an antenna formed by the first feeding point F1 of the patch antenna 200*a*.

Figure 10:
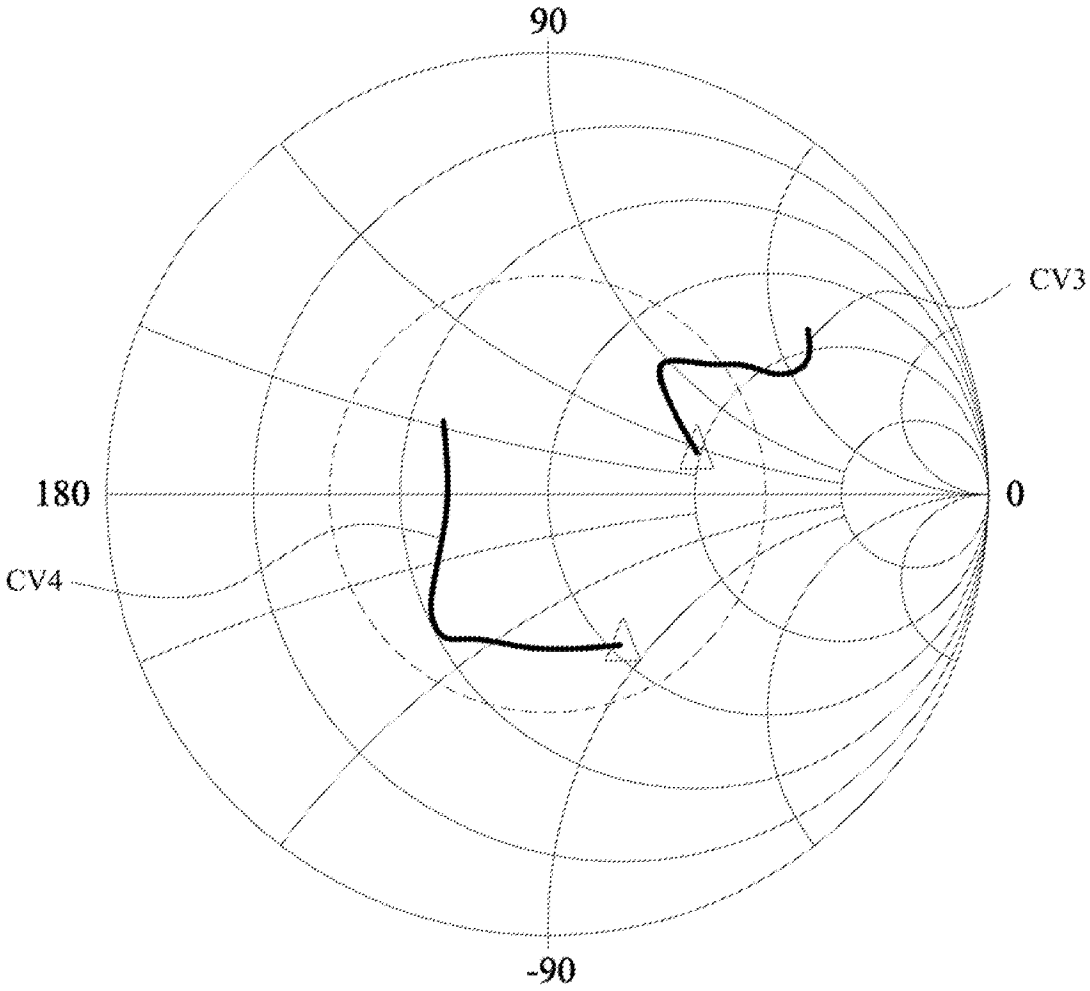
FIG. 10 illustrates a smith chart of patch antennas according to one embodiment of the present disclosure.

FIG. 10 illustrates a smith chart of patch antennas 200, 200*a* according to another embodiment of the present disclosure. Curve CV3 represents the antenna characteristic of an antenna formed by the second feeding point F2 of the patch antenna 200. Curve CV4 represents the antenna characteristic of an antenna formed by the second feeding point F2 of the patch antenna 200*a*.

Accordingly, by forming the first slot SL1 and/or the second slot SL2, the bandwidth and the impedance matching of the patch antenna 200*a* can be adjusted.

Figure 11:
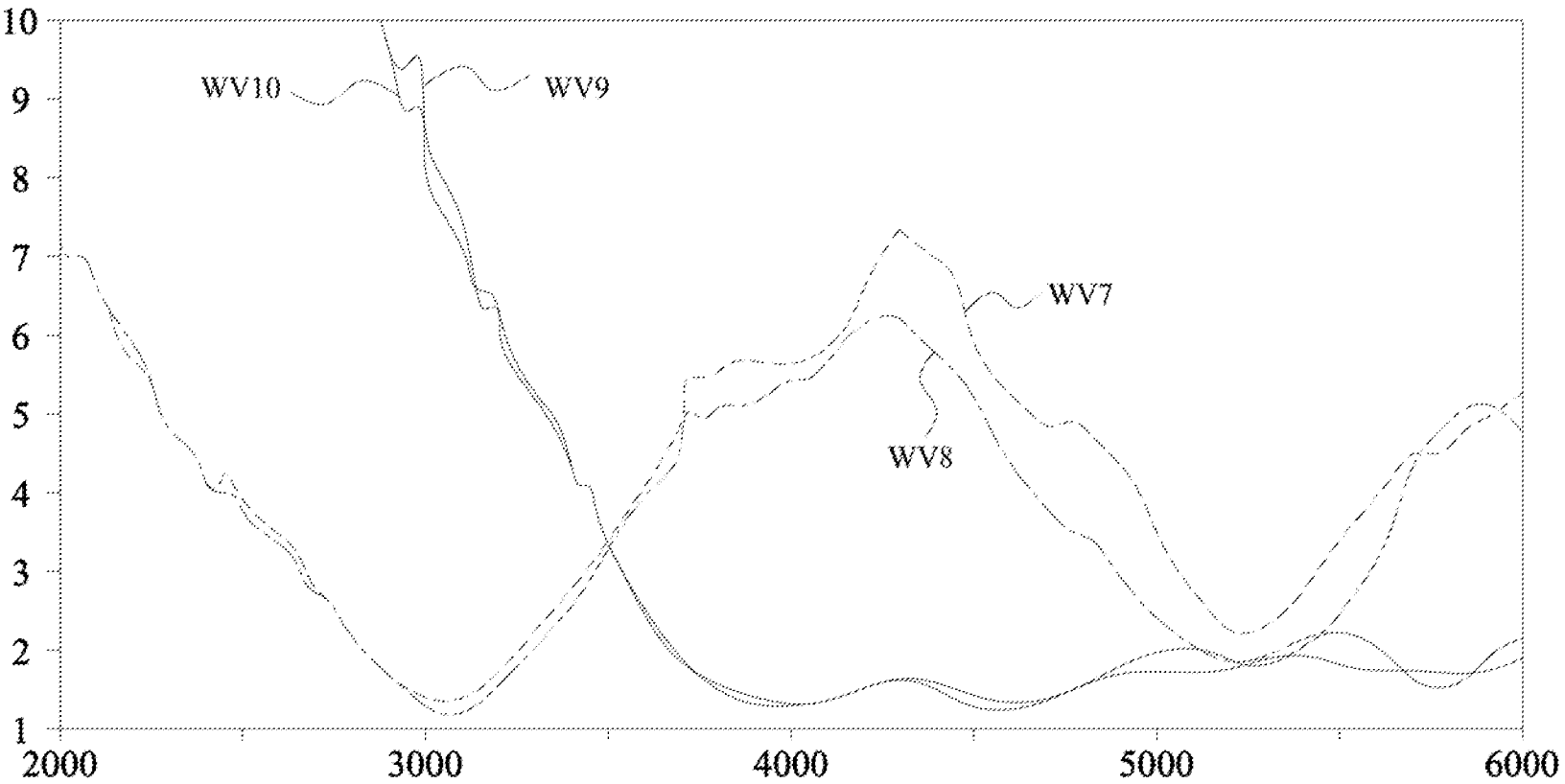
FIG. 11 illustrates relationships between frequencies and voltage standing wave ratios (VSWRs) of patch antennas according to one embodiment of the present disclosure.

FIG. 11 illustrates relationships between frequencies and voltage standing wave ratios (VSWRs) of patch antennas 200, 200*a* according to one embodiment of the present disclosure. The waveform WV7 indicates a relationship between a frequency and a voltage standing wave ratio (VSWR) of the first feeding point F1 of the patch antenna 200. The waveform WV8 indicates a relationship between a frequency and a voltage standing wave ratio (VSWR) of the second feeding point F2 of the patch antenna 200. The waveform WV9 indicates a relationship between a frequency and a voltage standing wave ratio (VSWR) of the first feeding point F1 of the patch antenna 200*a*. The waveform WV10 indicates a relationship between a frequency and a voltage standing wave ratio (VSWR) of the second feeding point F2 of the patch antenna 200*a*.

Accordingly, by forming the first slot SL1 and/or the second slot SL2, the patch antennas 200, 200*a* can have a low voltage standing wave ratio (VSWR) at 400 MHz-6000 MHz.

Although the present disclosure has been described in considerable detail with reference to certain embodiments thereof, other embodiments are possible. Therefore, the scope of the appended claims should not be limited to the description of the embodiments contained herein.

What is claimed is:

1. A patch antenna comprising:

a supporting element comprising a first surface and a second surface;

a grounding portion disposed at the second surface of the supporting element; and a radiating portion disposed at the first surface of the supporting element, wherein the radiating portion comprises:

a first feeding point located at a first end of the radiating portion;

a first grounding point located at a second end the radiating portion and electrically connected to the grounding portion, wherein the second end of the radiating portion is opposite to the first end of the radiating portion;

a second feeding point located at a third end of the radiating portion; and a second grounding point located at a fourth end of the radiating portion and electrically connected to the grounding portion, wherein, the fourth end of the radiating portion is opposite to the third end of the radiating portion;

wherein the line formed by connecting the first feeding point and the first grounding point is substantially perpendicular to the line formed by connecting the second feeding point and the second grounding point, and wherein the lines meet at substantially a geometric center of the radiating portion.

2. The patch antenna as claimed in claim 1, wherein the radiating portion is substantially symmetric along the line formed by connecting the first feeding point and the first grounding point.

3. The patch antenna as claimed in claim 1, wherein the radiating portion is substantially symmetric along the line formed by connecting the second feeding point and the second grounding point.

4. The patch antenna as claimed in claim 1, wherein a shape of the radiating portion is a cross, a circle, a rectangle, or a diamond.

5. The patch antenna as claimed in claim 1, wherein the radiating portion has a center point, and a distance between the first feeding point and the center point is substantially equal to a distance between the second feeding point and the center point.

6. The patch antenna as claimed in claim 1, wherein the radiating portion has a center point, and a distance between the first grounding point and the center point is substantially equal to a distance between the second grounding point and the center point.

7. The patch antenna as claimed in claim 1, wherein the radiating portion forms a first slot, and the first slot surrounds the first feeding point.

8. The patch antenna as claimed in claim 1, wherein the radiating portion forms a second slot, and the second slot surrounds the second feeding point.

9. A patch antenna for to a first signal source and a second signal source, the patch antenna comprising:

a grounding portion; and a radiating portion comprising:

a first feeding point electrically connected to the first signal source;

a first grounding point electrically connected to the grounding portion;

a second feeding point electrically connected to the second signal source; and a second grounding point electrically connected to the grounding portion;

wherein the line formed by connecting the first feeding point and the first grounding point is substantially perpendicular to the line formed by connecting the second feeding point and the second grounding point, and wherein the lines meet at substantially a geometric center of the radiating portion.

10. The patch antenna as claimed in claim 9, wherein the radiating portion is substantially symmetric along the line formed by connecting the first feeding point and the first grounding point.

11. The patch antenna as claimed in claim 9, wherein the radiating portion is substantially symmetric along the line formed by connecting the second feeding point and the second grounding point.

12. The patch antenna as claimed in claim 9, wherein a shape of the radiating portion is a cross, a circle, a rectangle, or a diamond.

13. The patch antenna as claimed in claim 9, wherein the radiating portion has a center point, and a distance between the first feeding point and the center point is substantially equal to a distance between the second feeding point and the center point.

14. The patch antenna as claimed in claim 9, wherein the radiating portion has a center point, and a distance between the first grounding point and the center point is substantially equal to a distance between the second grounding point and the center point.

15. The patch antenna as claimed in claim 9, wherein the radiating portion forms a first slot, and the first slot surrounds the first feeding point.

16. The patch antenna as claimed in claim 9, wherein the radiating portion forma a second slot, and the second slot surrounds the second feeding point.

* * * * *